US005442862A

United States Patent [19]

Newbold et al.

[11] Patent Number: 5,442,862

[45] Date of Patent: Aug. 22, 1995

[54] VARIABLY ADJUSTABLE ARCHERY BOW SIGHT

[75] Inventors: George T. Newbold; Theodore M. Davenport; Raymond L. Bray, all of Walla Walla, Wash.

[73] Assignee: Martin Archery, Inc., Walla Walla, Wash.

[21] Appl. No.: 114,311

[22] Filed: Aug. 30, 1993

[51] Int. Cl.[6] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 2,559,927 | 7/1951 | Beloungy | 33/265 |
| 2,654,152 | 10/1953 | La Vire | 33/265 |
| 3,163,938 | 1/1965 | Reynolds | 33/265 |
| 3,487,548 | 1/1970 | Frydenlund | 33/265 |
| 3,674,002 | 7/1972 | Diamond, Sr. | 33/265 |
| 4,153,999 | 5/1979 | O'Steen | 33/265 |
| 4,178,693 | 12/1979 | Smith | 33/265 |
| 4,497,116 | 2/1985 | Hawkins | 33/265 |
| 5,001,837 | 3/1991 | Bray | 33/265 |

*Primary Examiner*—Christopher W. Fulton

*Attorney, Agent, or Firm*—Wells, St. John, Roberts, Gregory & Matkin

[57] ABSTRACT

An archery bow sight includes a stationary block and a ranging slide bar mounted adjacent thereto. A linkage assembly enables movement of the ranging slide bar relative to stationary block and in a plane parallel to the stationary block within a range of movement. An adjustable link allows the range of movement of the ranging slide bar to be adjusted. Another aspect of the invention involves an incrementally adjustable archery bow sight including an indexing means for controlled, incremental adjustments of a sight device mounted to the bow sight. Yet another aspect of the invention involves an archery bow sight with an incrementally adjustable ranging slide bar.

24 Claims, 14 Drawing Sheets

VARIABLY ADJUSTABLE ARCHERY BOW SIGHT

TECHNICAL FIELD

This invention relates to adjustable archery bow sights.

BACKGROUND OF THE INVENTION

There are many types of archery bow sights. An archery bow sight enables an archer to position the bow so that it will launch an arrow and hit a target at a given distance from the archer. Without a bow sight, the archer must "instinctively" guess where the bow should be positioned to shoot an arrow so that it will hit the target.

Most archery bow sights are adjustable to compensate for numerous variables that affect arrow trajectory. Some of these variables include the characteristics of the bow and arrow, the archer, and the shooting method employed by the archer. Any variation of one of these variables will potentially change arrow flight. An adjustable archery bow sight enables a sight device (such as a sight pin or cross hair) on the archery bow sight to be adjusted to compensate for such variables so that the arrow strikes a target at a given distance when the corresponding sight device is aimed at the target.

Many traditional archery bow sights include multiple sight devices. The sight devices typically are adjusted to correspond with various target distances at certain intervals (e.g., ten yards, twenty yards, thirty yards, etc.). In view of the sensitivity of the bow to the aforementioned variables, adjustments of these sight devices is often necessary.

Efforts have been made to develop archery bow sights with a single, adjustable sight device for referencing a target spaced from the archer. These types of bow sights prevent the archer from placing the wrong sight pin on the target. One such adjustable archery bow sight is disclosed in U.S. Pat. No. 5,001,837. This type of bow sight enables the archer to move the sight device through a range of movement to correspond with several different target distances. The sight device will preferably move within a range of movement from a point referencing a target at a relatively close range (e.g., ten yards) to a point referencing the archer's maximum effective range (e.g., forty or fifty yards).

Prior archery bow sights have yet to provide a means for adjusting the range of movement of a movable sight device to compensate for the variables of the bow, the arrows, and the shooter. For example, an archery bow that launches arrows at a high velocity will require a movable sight device to pass through a relatively small range of movement to reference targets distances of ten, twenty, and thirty yards, as compared to an archery bow that launches arrows at a relatively slower velocity.

Most traditional sights are cumbersome and difficult to adjust. Typically, the adjustment process requires at least two hands: one to loosen the sight device, and a second hand to stabilize and move the sight device once it has been loosened, and to hold the sight device until it is secured in place by the first hand.

This method results in imprecise and nonincremental adjustments because the distance the sight device is moved cannot be quantified or duplicated exactly. Instead, the person adjusting the sight must guess how much the sight device should be moved. Over-adjustments are commonly made which require the sight device to be moved back toward its original position. Again, the person making the adjustments must guess as to how far the sight device must be moved.

There remains a need, therefore, to provide an archery bow sight which is easy to use, includes a minimal number of working parts, and has an adjustable range of movement. There is also a need to provide an archery bow sight which is controllably and incrementally adjustable.

BRIEF DESCRIPTION OF THE DRAWINGS

Preferred embodiments of the invention are described below with reference to the accompanying drawings, which are briefly described below.

FIG. 5 is an enlarged top plan view of the archery bow sight of FIG. 1;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of the invention, an archery bow sight, comprising:

a base member;

a stationary block coupled to the base member;

a ranging slide bar mounted adjacent the block, the slide bar being controllably moveable in a plane parallel to the block within a range of movement;

a range marker fixedly coupled to the ranging slide bar for movement therewith;

a sight device fixedly coupled to the ranging slide bar for movement therewith; and a lever pivotally coupled to the ranging slide bar to controllably move the slide bar through the range of movement.

In accordance with another aspect of the invention, an archery bow sight, comprising:

a base member;

a stationary block coupled to the base member;

a ranging slide bar mounted adjacent the block, the slide bar being controllably moveable relative to the block through a range of movement;

a sight device fixedly coupled to the ranging slide bar for movement therewith;

a range gauge coupled to the stationary block, the range gauge including a plurality of reference points;

a range marker fixedly coupled to the ranging slide bar for movement therewith, the range marker indicating a particular reference point on the range gauge;

a moveable lever coupled to the ranging slide bar to impart an output rate of movement to the slide bar upon an input rate of movement being implemented to the lever, thus defining an input-to-output speed ratio; and adjustment means for varying the speed ratio.

Figure 1:
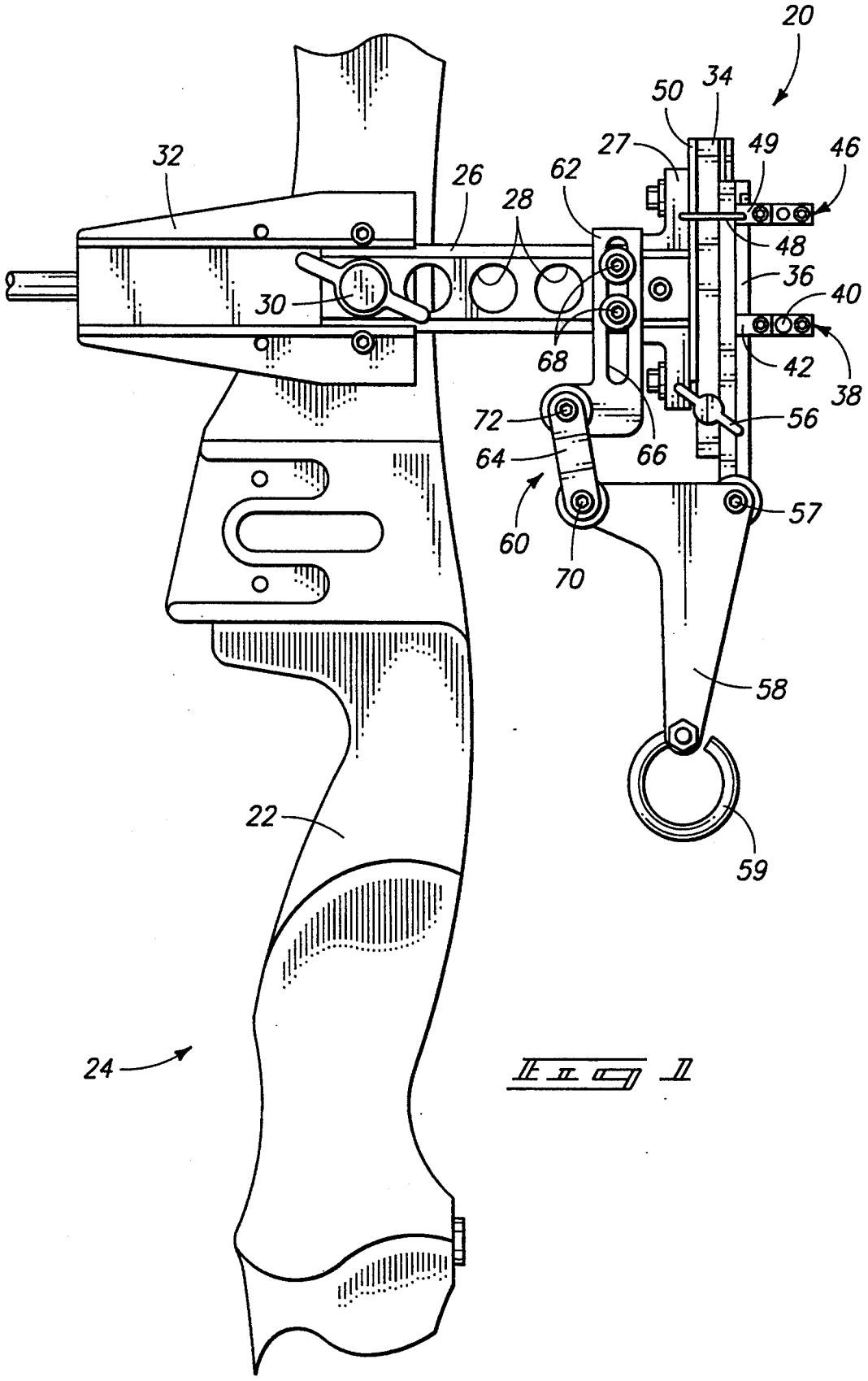
FIG. 1 is a left side elevation view of a preferred embodiment of an archery bow sight made in accordance with the present invention.
Figure 2:
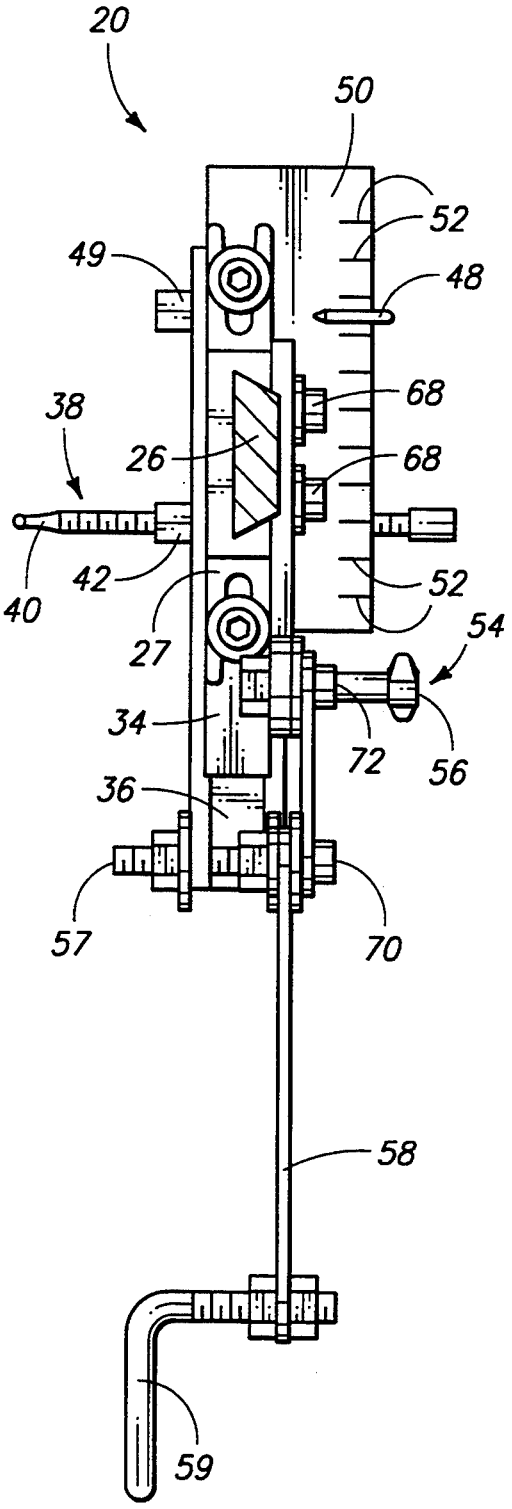
FIG. 2 is a rear elevation view of the archery bow sight of FIG. 1.
Figure 3:
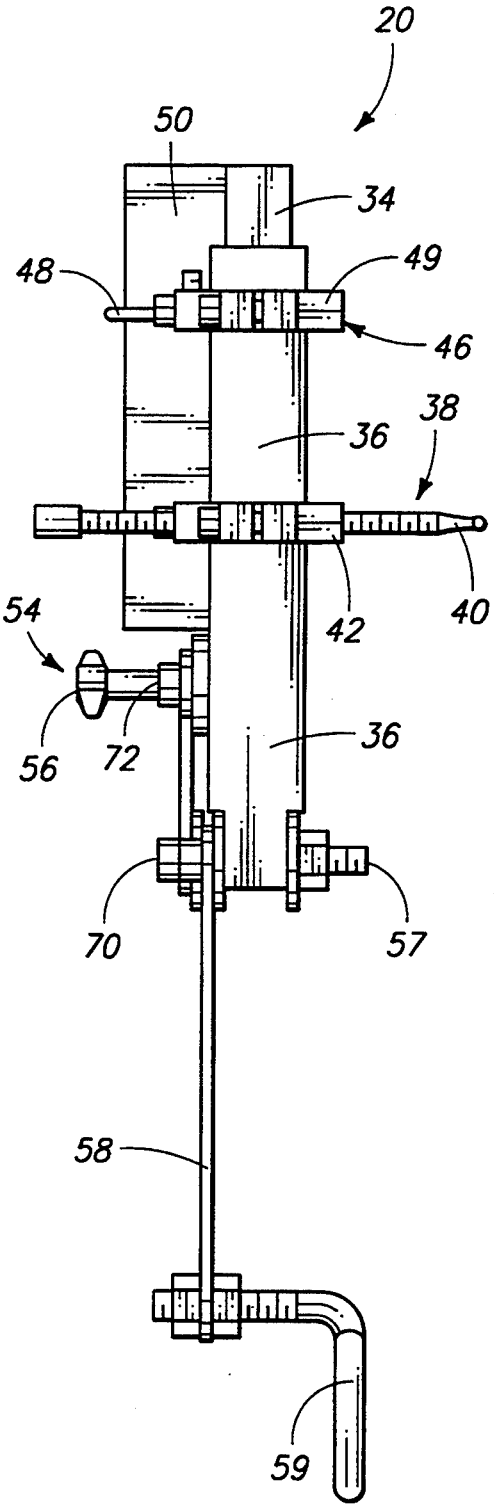
FIG. 3 is a front elevation view of the archery bow sight of FIG. 1.
Figure 4:
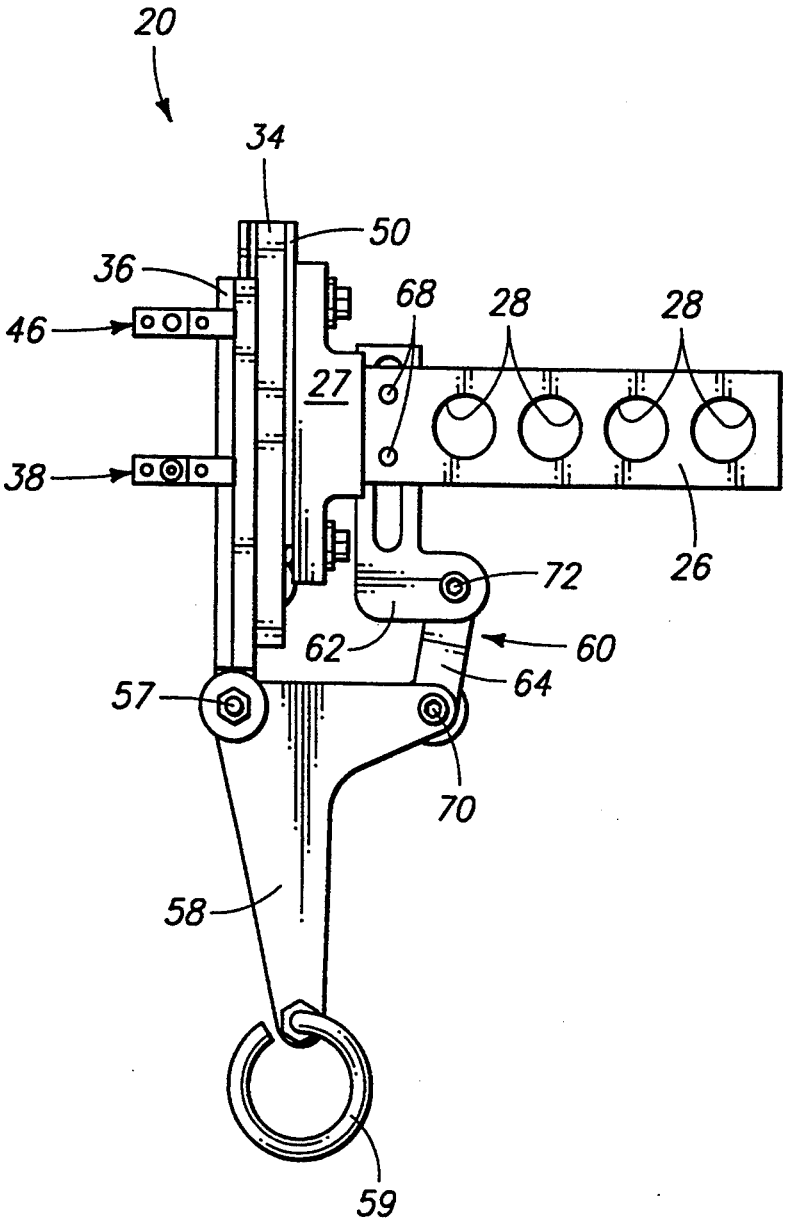
FIG. 4 is a right side elevation view of the archery bow sight of FIG. 1.
Figure 4:
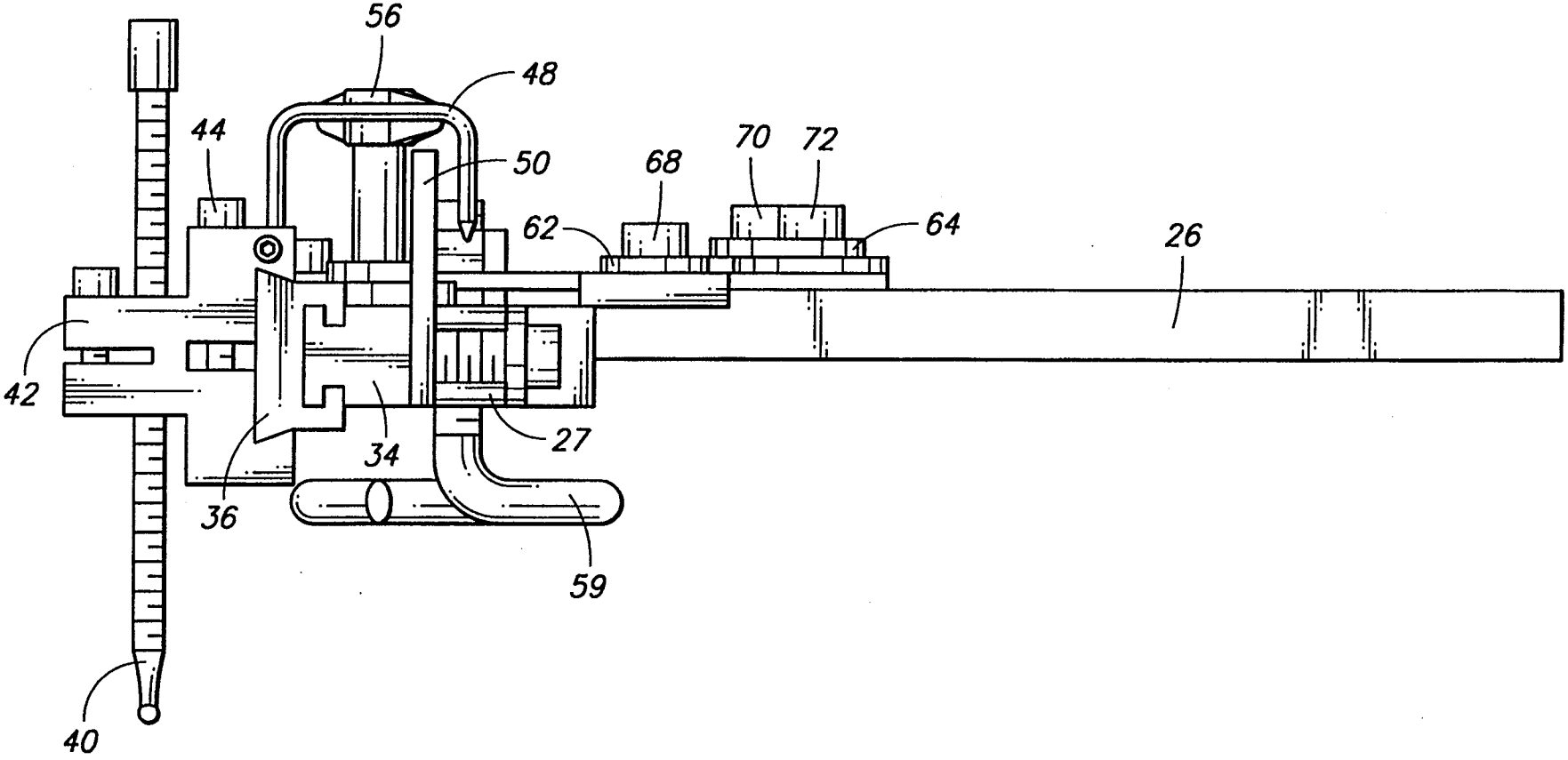

More particularly, FIGS. 1–10 show an archery bow sight 20 coupled to a handle riser portion 22 of an archery bow 24. The bow sight 20 includes a base member 26 having a plurality of mounting apertures 28 for securing the bow sight 20 at various distances relative to the handle riser 22. A fastener 30 with a T-shaped knob secures the base member 26 to the handle riser portion 22 through one of the apertures 28. Although the embodiment of FIG. 1 shows the base member 26 mounted to the handle riser 22 through a cable guard base plate 32, the base member could alternatively be coupled to the handle riser portion either directly or through another type of mounting adapter.

Figure 8:
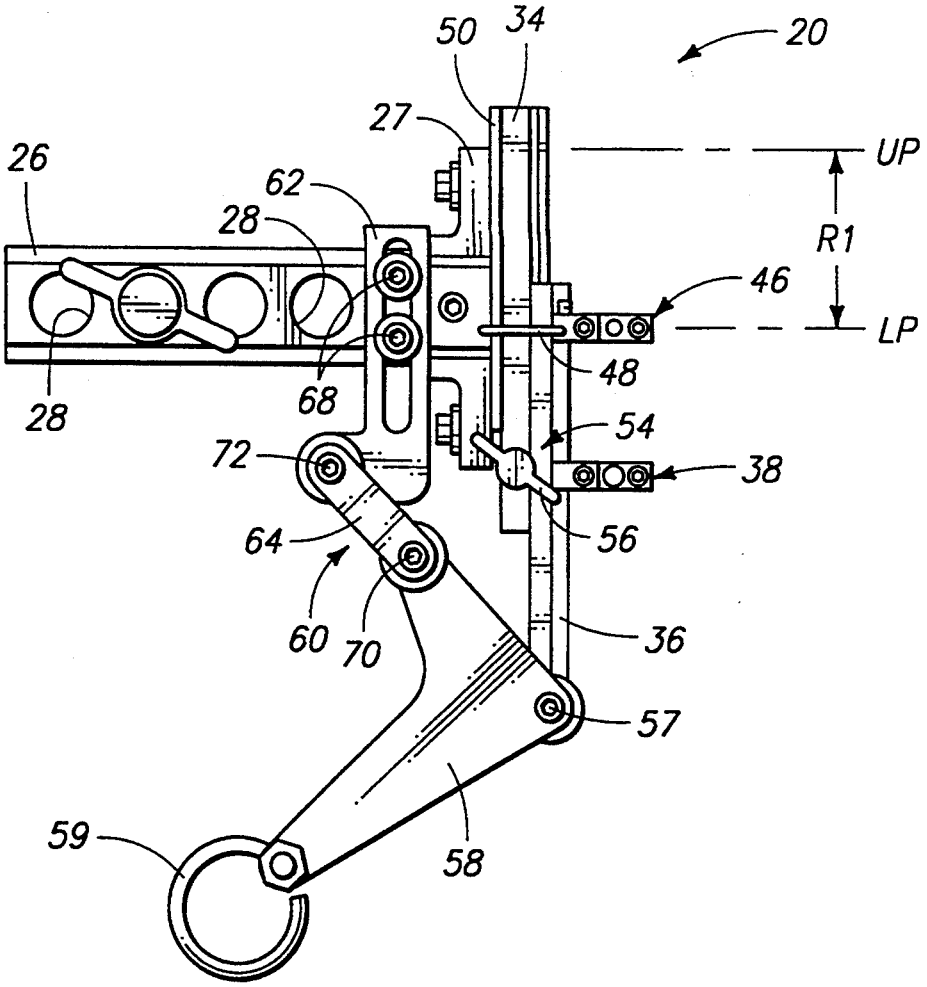
FIG. 8 is a left side elevation view of the archery bow sight of FIG. 1 illustrating a first range of movement of the sight device.

The archery bow sight 20 further includes an end adapter 27 coupled to the base member 26. A stationary block 34 is coupled to the base member 26 through the end adapter. A ranging slide bar 36 is slidably mounted adjacent the stationary block. The stationary block 34 and the ranging slide bar 36 are nested together to allow controllable and slidable movement of the slide bar relative to the stationary block in a plane parallel to the stationary block within a range of movement R1 (FIG. 8).

A sight device 38 is fixedly coupled to the ranging slide bar 36 for movement therewith. In the embodiment shown in FIGS. 1–10, the sight device comprises a sight pin 40 threadably received within a mounting bracket 42. The pin can be rotatably adjustable to various positions relative to the bracket 42. The bracket 42 also can be adjusted relative to the ranging slide bar 36. The mounting bracket 42 is sized to slidably receive the dove-tail shaped slide bar (FIG. 5). The mounting bracket 42 is secured in place by means of a clamp screw 44.

A range marker 46 is also coupled to the ranging slide bar 36 for movement therewith. The range marker includes an indicator pin 48 coupled to a mounting bracket 49 which also slidably receives the dove-tail shaped ranging slide bar 36. The mounting bracket 49 can be secured to the ranging slide bar 36 at a variety of locations. The indicator pin moves with the ranging slide bar to reference or indicate a point on the range gauge 50 (discussed below) within the range of movement of the slide bar. The mounting bracket 49 is secured to the ranging slide bar with a clamp screw (not shown), which is similar to the clamp screw 44 used to secure the sight pin mounting bracket 42 to the slide bar.

A range gauge 50 is coupled to the bow sight between the stationary block 34 and the end adapter 27. The range gauge is positioned adjacent the ranging slide bar 36 for reference by the indicator pin 48. The range gauge includes a plurality of reference marks in the form of graduations 52. The indicator pin 48 of the range marker 46 moves with the ranging slide bar 36 relative to the stationary block and range gauge 50. The indicator pin provides the archer with a quick, precise method of referencing the graduations. The range gauge 50 is substantially planar to further facilitate readings of the graduations by maintaining the graduations within a single plane.

The archery bow sight 20 further comprises a lock assembly 54 (FIGS. 2 and 3) for restricting relative movement between the ranging slide bar 36 and the stationary block 34. The lock assembly includes a lock screw 56 having a T-shaped adjustment knob for easy loosening and tightening. The lock screw is threadably received by the stationary block, and is bearable against the ranging slide bar. This direct engagement with the ranging slide bar provides a direct force applied against the slide bar to prevent movement relative to the stationary block.

The archery bow sight 20 additionally includes a control means for controllably moving the ranging slide bar relative to the stationary block. More specifically, as shown in FIGS. 1–10, the control means includes a lever 58 pivotally coupled at pivot point 57 to the ranging slide bar 36 to controllably move the slide bar through the range or movement R1 (FIG. 8). Upon implementing an input rate of movement to the lever 58, the lever moves relative to the base member 26 and imparts an output rate of movement to the slide bar 36, thus defining an input-to-output speed ratio. That is, movement of the lever 58 of the control means is proportional to movement of the ranging slide bar 36. An annular control ring 59 is coupled to a lower end of the lever 58 for facilitating movement thereof. The control ring is configured to receive a finger of the archer's hand which holds the bow to enable controllable movement of the lever.

Referring still to FIGS. 1–10, the archery bow sight 20 further comprises a linkage assembly 60 pivotally interconnecting the lever 58 and the base member 26. The linkage assembly includes an adjustable link 62 and a multiple pivot point linkage assembly in the form of a dual pivot member 64. The adjustable link is fixedly coupled to the base member by means of fasteners 68, and is pivotally coupled to the dual pivot member at upper pivot point 72. The dual pivot member is coupled, in turn, to the lever 58 at lower pivot point 70.

The adjustable link 62 defines an elongated slot 66 through which a plurality of fasteners 68 secure the adjustable link to the base member 26. The elongated slot 66 provides an adjustment means which allows the adjustable link to slide relative to base member 26. Moving the slot 66 relative to the fasteners 68 changes the location of pivot point 72 to thereby adjust the range of movement through which the ranging slide bar 36 passes. It is to be understood that other known mechanisms could be used to change the length of link 62 and thereby to change the location of pivot point 72.

That is, moving the adjustable link for mounting at different locations along slot 66 adjusts the range of movement of the ranging slide bar resulting from a constant travel range of the lever. The adjustment means is thus capable of varying the proportionality of control means movement to ranging slide bar movement. Stated in yet another way, the adjustment means varies the output rate of movement of the slide bar for a constant input rate of movement of the control means. The adjustable link is secured in place relative to the base member once the desired range of movement is achieved.

A multiple pivot point linkage in the form of dual pivot member 64 is pivotally connected between the lever 58 and the adjustable link 62 to enable travel of the ranging slide bar 36 in a plane parallel to the block. The unique linkage assembly 60 of the present invention, including the dual pivot member, reduces the bulkiness of the slight, requires less moving parts than traditional moveable sights, and allows the sight to be easily adjusted.

Figure 6:
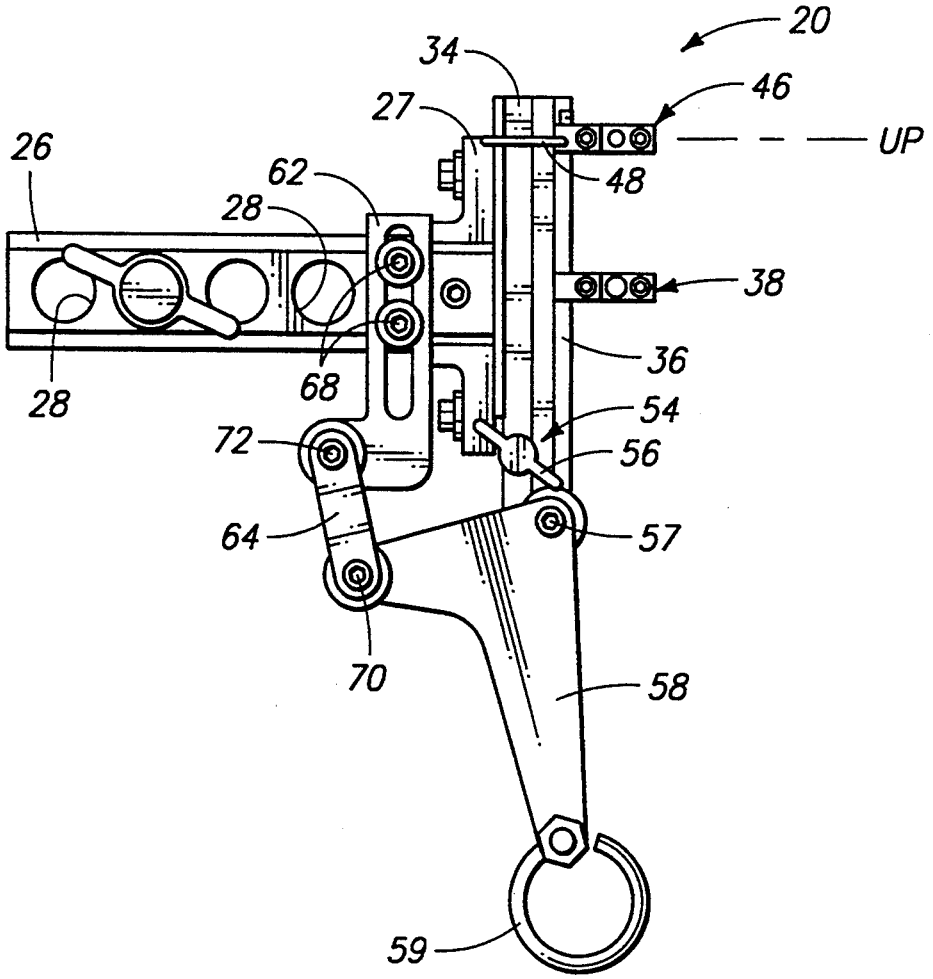
FIG. 6 is a left side elevation view of the archery bow sight of FIG. 1 illustrating the sight device at an extreme upper position within its range of movement.

Adjustment of the range of movement (R1, R2, and R3) of the slide bar 36 by means of the adjustable link is shown in FIGS. 6–10. In FIG. 6, the lever 58 is extended outward away from the bow (not shown) as far as possible. This moves the indicator pin 48 to an extreme upper position UP relative to the range gauge 50. In FIG. 6, the adjustable link 62 is fixedly coupled to the base member 26 at a first adjusted position. Assuming the pin 48 remains in the same position relative to the ranging slide bar 36, the extreme upper position UP of the pin 48 shown in FIG. 6 will remain constant even when the adjustable link 62 is moved relative to the base member 26. This fixed, extreme upper position provides a base line from which various ranges of movement can be measured.

Figure 7:
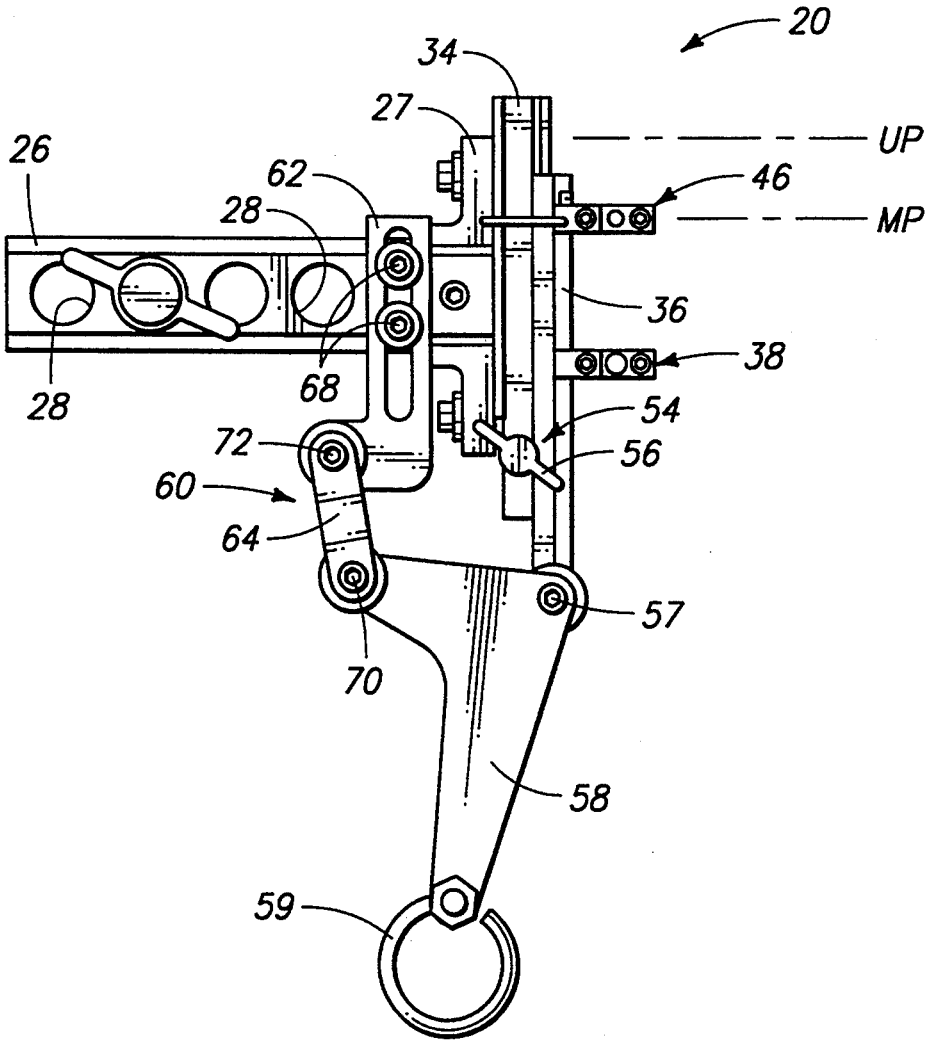
FIG. 7 is a left side elevation view of the archery bow sight of FIG. 1 illustrating the sight device at a middle position within its range of movement.

FIG. 7 shows the archery bow sight 20 with the adjustable link 62 remaining in the first adjusted position. The lever 58 has been moved toward the bow (not shown) or toward the left-hand side of the drawing of FIG. 7. The pin indicator 48 has correspondingly moved to a middle position MP relative to the extreme upper position UP shown in FIG. 6. There are an infinite number of such middle positions that the pin 48 can occupy within the range of movement.

FIG. 8 shows the archery bow sight 20 with the adjustable link still in the first adjusted position with the lever 58 shown in a fully retracted position closest to the bow (not shown). The pin indicator 48 is thereby moved in an extreme lower position LP. A first range of movement R1 is defined by the distance between the constant extreme upper position UP and the extreme lower position LP of pin 48 when the adjustable link is in the first adjusted position.

Figure 9:
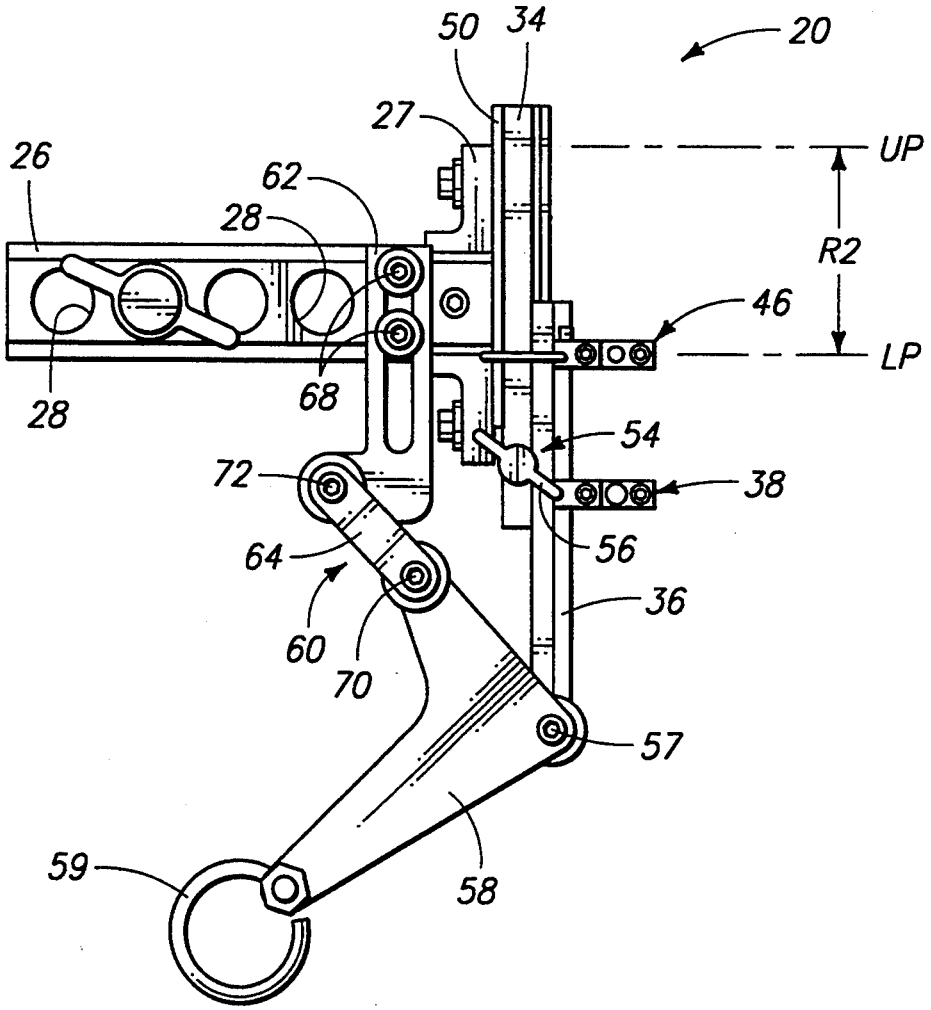
FIG. 9 is a left side elevation view of the archery bow sight of FIG. 1 illustrating a second range of movement of the sight device.

FIG. 9 shows the adjustable link 62 in a second adjusted position relative to the base member 26. As described above, the extreme upper position UP of the indicator pin remains constant regardless of the position of the adjustable link 62. FIG. 9 shows an extreme lower position LP of the indicator pin when the adjustable link 62 is moved to the second adjusted position. A second range of movement R2 is defined by the distance between the constant extreme upper position UP and the lower position LP of pin 48 when the adjustable link is in the second adjusted position. It can readily be noted that the second range of movement R2 (FIG. 9) is greater than the first range of movement R1 (FIG. 8).

Figure 10:
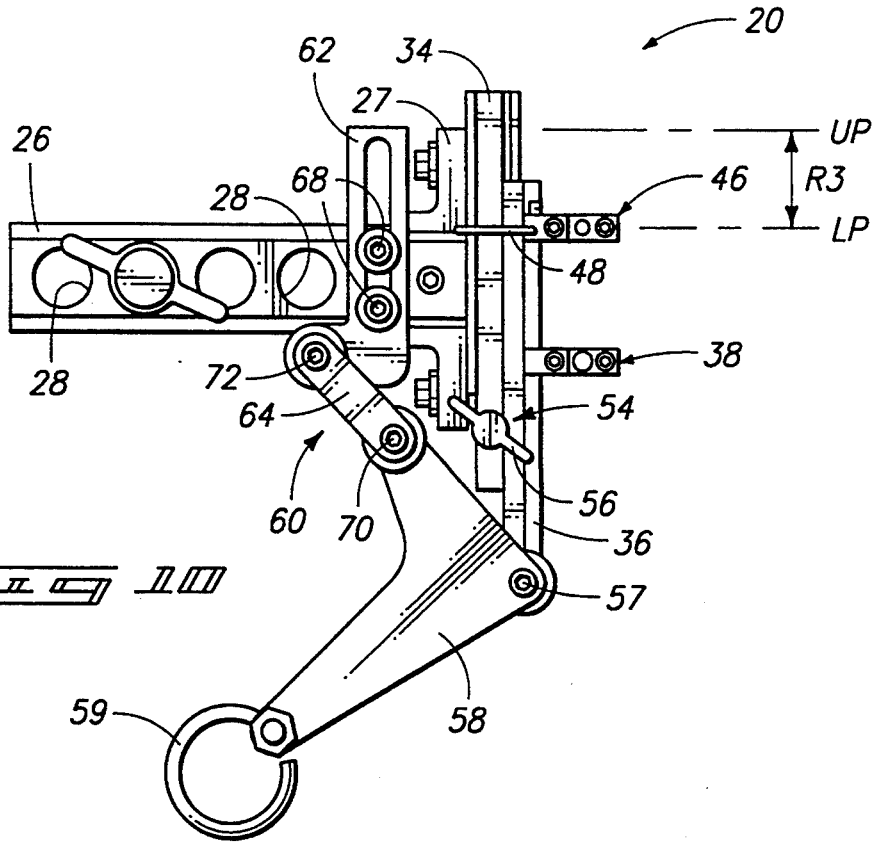
FIG. 10 is a left side elevation view of the archery bow sight of FIG. 1 illustrating a third range of movement of the sight device.

FIG. 10 shows the adjustable link secured to the base member at a third adjusted position (the lowermost position). In FIG. 10, fasteners 68 secure the adjustable link at the third adjusted position to the base member 26 through the elongated slot 66. As described above, the extreme upper position UP of the indicator pin 48 remains constant. FIG. 10 shows an extreme lower position LP of the indicator pin when the adjustable link 62 is moved to the third adjusted position. A third range of movement R3 is defined by the distance between the constant extreme upper position UP and the lower position LP of pin 48 when the adjustable link is in the third adjusted position. It can readily be noted that the third range of movement R3 (FIG. 10) is smaller than either the first range of movement R1 (FIG. 8) or the second range of movement R2 (FIG. 9).

It should be noted that as the range of movement is varied, so too is the rate at which the slide bar 36 travels per a given rate of movement of the lever 58. Since the lever movement remains constant, and the range of movement of the slide bar 36 varies upon adjustment of the adjustable link, the ratio of movement between the lever and the slide bar must necessarily change.

Accordingly, for the same rate and range of movement of lever 58, both the range and the rate of movement of the slide bar 36 will be less when the adjustable link 62 is secured at the third adjusted position (FIG. 10) than when the adjustable link is secured at the first or second adjusted positions (FIGS. 8 and 9, respectively). The third adjusted position would be a preferred adjusted position of the bow sight 20 when mounted on a relatively fast or fiat shooting bow. Thus, the adjustment means or adjustable link provides a means for varying the speed ratio of or proportionality of movement between the input rate of movement to the lever as compared to the output rate of movement of the ranging slide bar.

FIGS. 11–15 illustrate another aspect of the present invention involving an incrementally adjustable archery bow sight 80. Sight 80 includes a support structure in the form of a frame 82 having a top wall 84, a bottom wall 86, and side walls 88 and 90. Side wall 90 provides support for a plurality of sight devices 92, 94, 96, and 98. One preferred type of sight device, shown in FIGS. 11–16, is a rotatably adjustable sight pin. It is to be understood, however, that other types of sight devices, such as cross-hair devices, flanges, or the like, could similarly be used in connection with the present invention.

Figure 12:
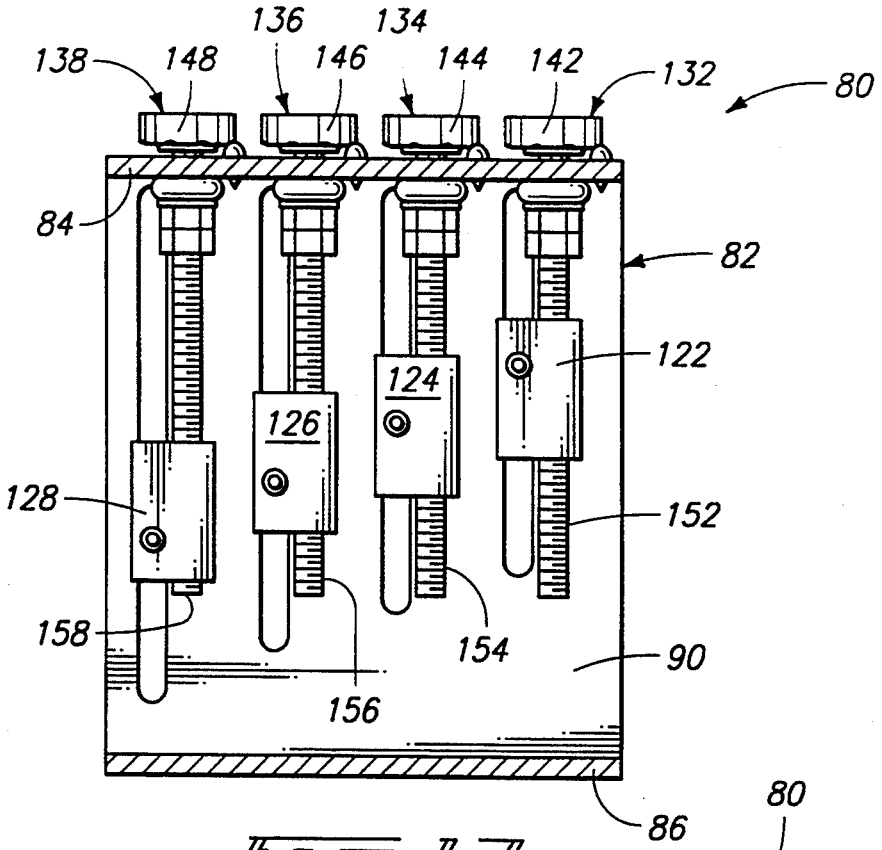
FIG. 12 is a side elevation view, taken along line 12—12, of the archery bow sight of FIG. 11.
Figure 13:
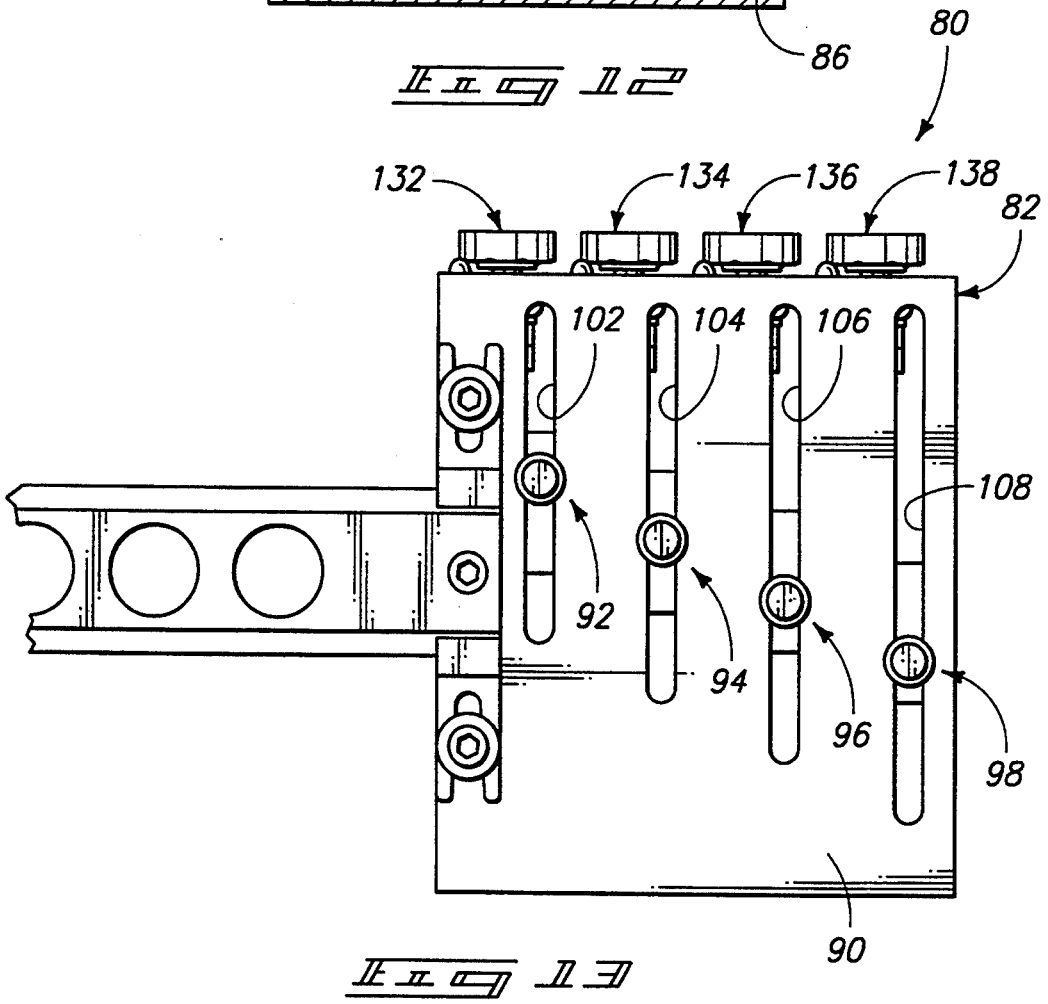
FIG. 13 is a left side elevation view of the archery bow sight of FIG. 11.

As shown in FIGS. 12 and 13, the sight devices 92–98 are mounted through respective slots 102, 104, 106, and 108. The slots vary in length to correspond with vertical ranges of movement for the respective sight devices. For example, sight device 92 is intended to be positioned to correspond with a target located closest to the archer and therefore has a slot 102 which is the shortest relative to the other slots. On the other extreme, sight device 98 is intended to be positioned to correspond with a target located farthest from the archer and therefore has a slot 108 which is the longest relative to the other slots.

Figure 11:
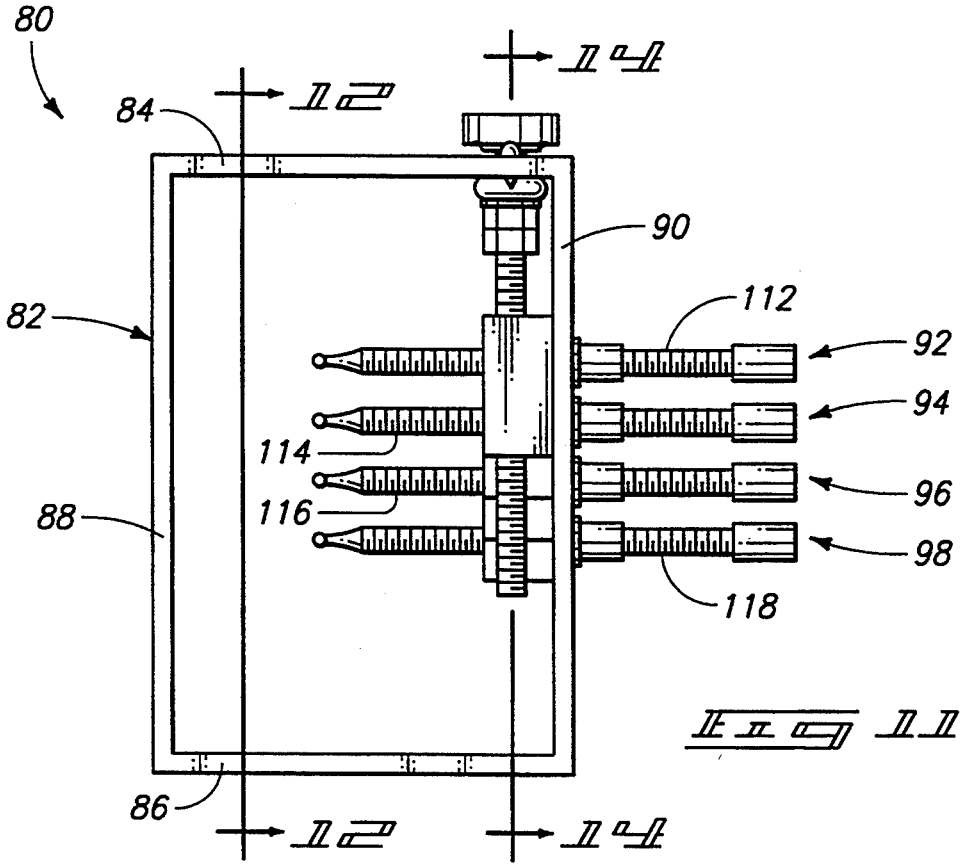
FIG. 11 is a front view of another aspect of the present invention illustrating a preferred embodiment of an incrementally adjustable archery bow sight.

As shown in FIGS. 11–13, the sight devices 92–98 include respective sight pins 112, 114, 116, and 118 threadably received by sliding blocks 122, 124, 126, and 128. Each of the sight pins is transversely adjustable relative to the vertical axis by rotating the sight pin relative to the respective sliding block to adjust the lateral position of the respective pins. Such transverse adjustments are conventional.

The incrementally adjustable sight 80 further comprises a plurality of elongated, threaded adjustment members 132, 134, 136, and 138 rotatably coupled to the top wall 84 of the support structure 82. Respective knobs 142, 144, 146, and 148 are coupled to the respective ends of the adjustment members 132–138. The adjustment members 132–138 include respective elongated threaded shafts 152, 154, 156, and 158 threadably received by the respective sliding blocks 122–128. The sliding blocks 122–128 are mounted for movement relative to the respective adjustment members 132–138.

Figure 14:
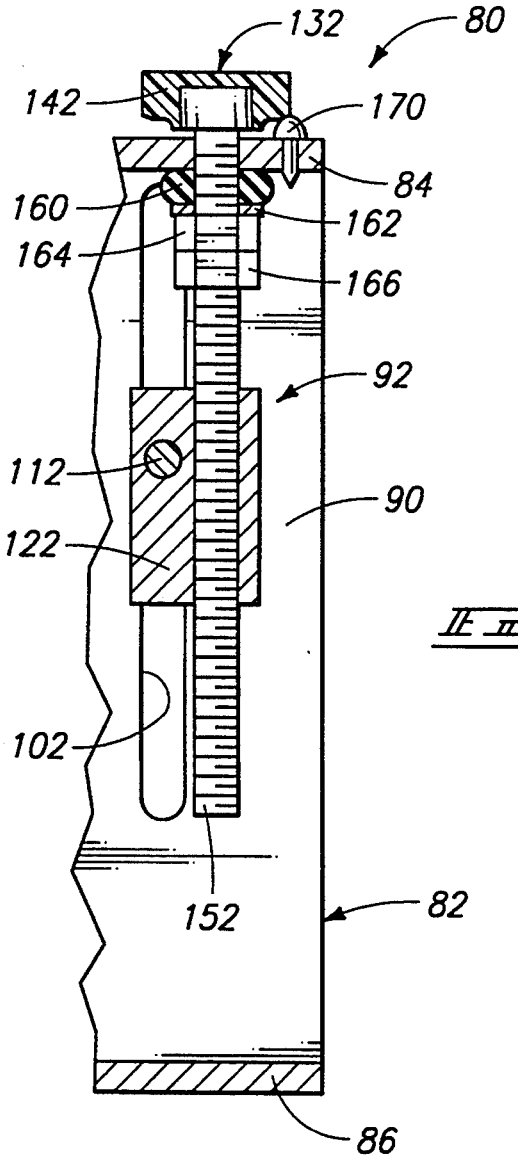
FIG. 14 is a sectional view taken, along the line 14—14, of the archery bow sight of FIG. 11.

For simplicity, FIG. 14 is provided to illustrate the operation of adjustment member 132. Operation of the other adjustment members 134–138 is substantially identical to the operation of adjustment member 132. The adjustment member 132 further comprises a resilient bias member 160, a flat washer 162, a first nut 164, and a second nut 166. The resilient bias member is compressed between the top wall 84 and the flat washer 162 to provide a downward tensioning force on the knob 142 when first nut 164 is tightened. The second nut 166 is subsequently tightened to lock the first nut 164 in a desired position to maintain the resilient member under a desired amount of compressive force.

Figure 15:
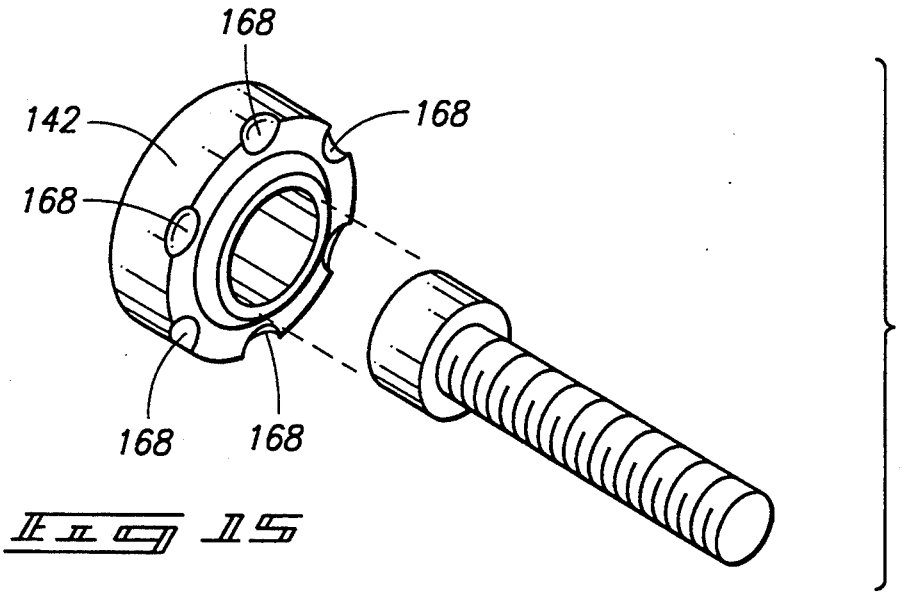
FIG. 15 is an exploded isometric view of a control knob used in connection with the adjustment member of FIG. 14.

FIG. 15 shows the control knob 142 as including an indexing means in the form of a plurality of detents 168 located at spaced radial positions about the periphery of the control knob. A corresponding protuberance or indexing button 170 forms part of the indexing means and is secured to the top wall 84 of the bow sight 80. The detents are configured to correspond with a rounded top surface of the indexing stop button 170. The detents 168 allow the control knob to be rotated in controllable, incremental movements. That is, the knob is rotatable in increments by sequential engagement of the detents with the protuberance. Such controlled movements of the knob cause the sliding block 122 (FIG. 14) to move up and down relative to the support structure 82 of the sight device 80 for adjusting the vertical position of the sight pin 112.

Figure 16:
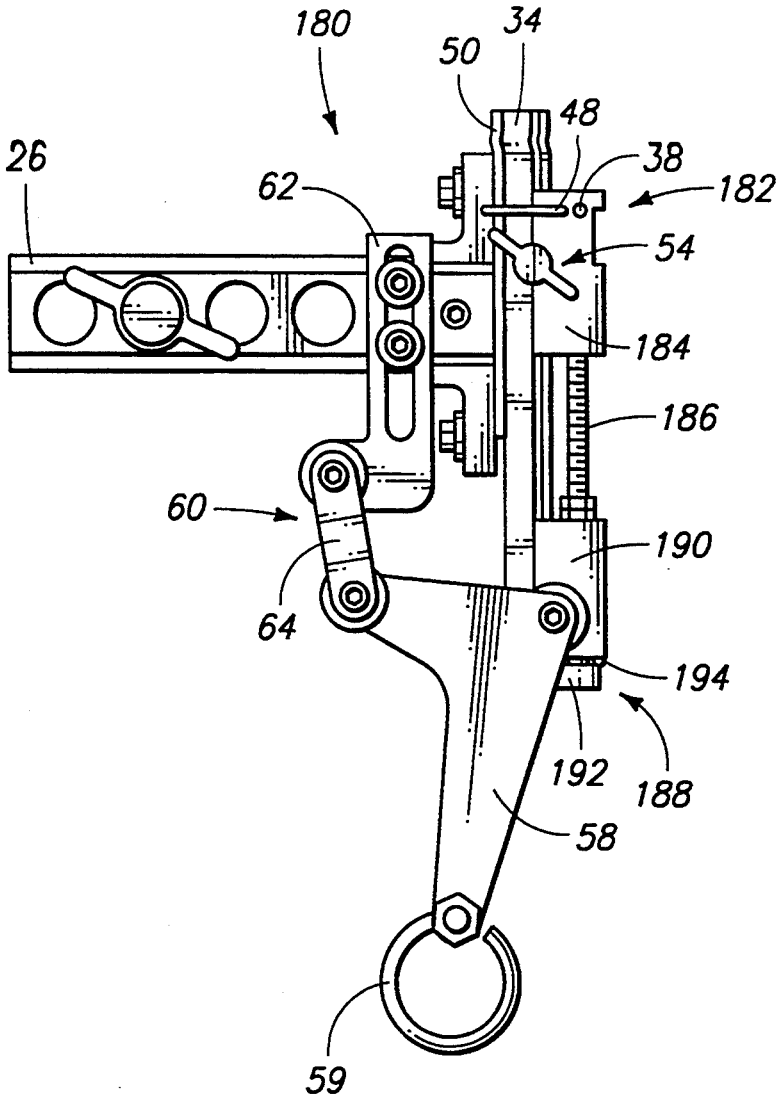
FIG. 16 is a left side elevation view of an alternative embodiment of the present invention showing an incrementally adjustable ranging slide bar incorporated into the adjustable archery bow sight illustrated in FIG. 1.

FIG. 16 shows yet another aspect of the present invention. An archery bow sight 180 is constructed in a manner similar to the archery bow sight 20 illustrated in FIGS. 1–10, except that the ranging slide bar 36 shown in FIGS. 1–10 has been replaced by an incrementally adjustable slide bar 182. The incrementally adjustable slide bar is slidably coupled to the stationary block 34 for movement relative thereto similar to the ranging slide bar 36. However, the incrementally adjustable slide bar 182 can be lengthened or shorted to locate the indicator pin 48 at various positions relative to the range gauge. Thus, incrementally adjustable slide bar 182 allows precise, incremental adjustments of the bow sight 182.

More specifically, the adjustable slide bar 182 includes a sight block 184 upon which the indicator pin 48 and the sight device 38 are mounted. The sight block 184 receives a threaded shaft 186 of an elongated threaded adjustment member 188 threadably coupled to a base block 190. The elongated adjustment member further includes a control knob 192 including a plurality of detents (not shown) for engaging an indexing stop member 194. Operation of the incrementally adjustable slide bar is substantially the same as described above in connection with the adjustment member 132 shown in FIG. 14. A plurality of radial detents (not shown in FIG. 16) engage the indexing stop button or protuberance 194 to enable controlled, incremental vertical adjustment of the position of the sight block.

Figure 17:
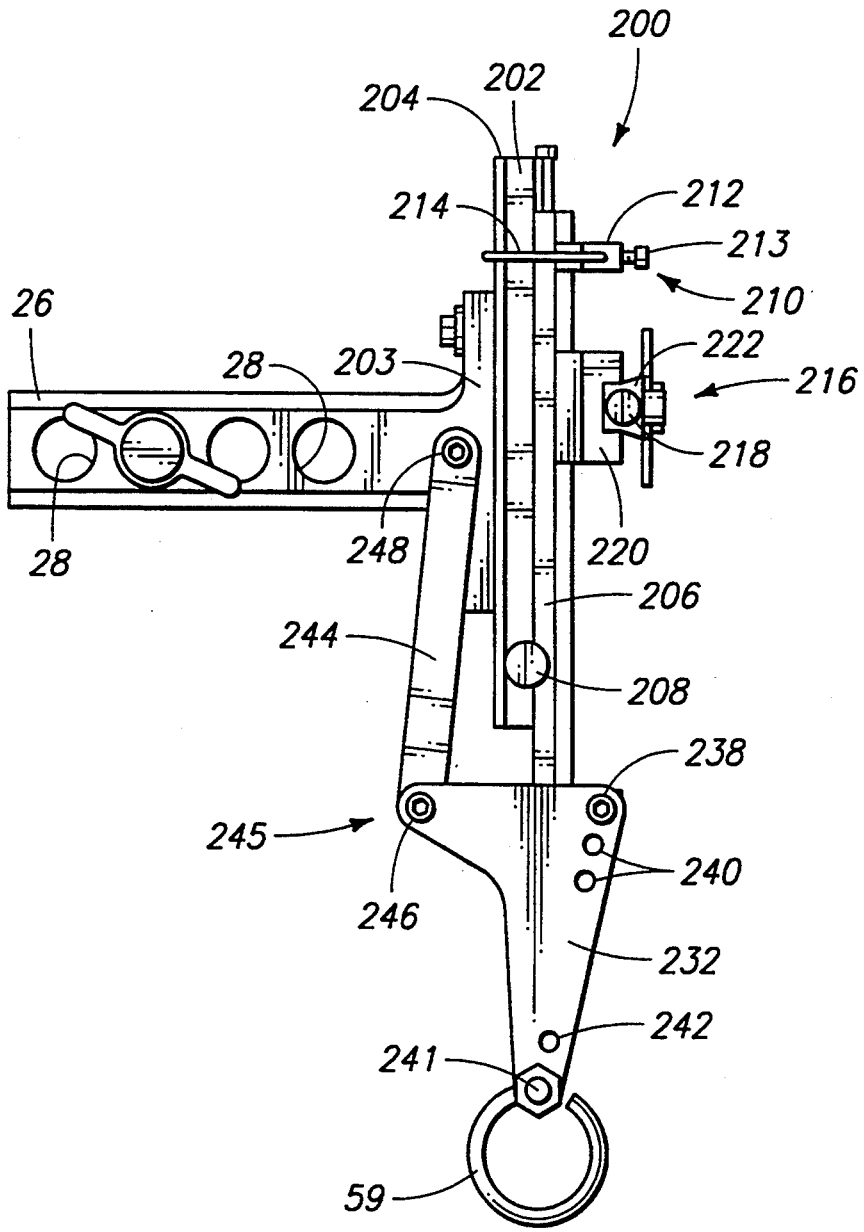
FIG. 17 is a left side elevation view of another alternative embodiment of the variably adjustable archery bow sight made according to the present invention.
Figure 18:
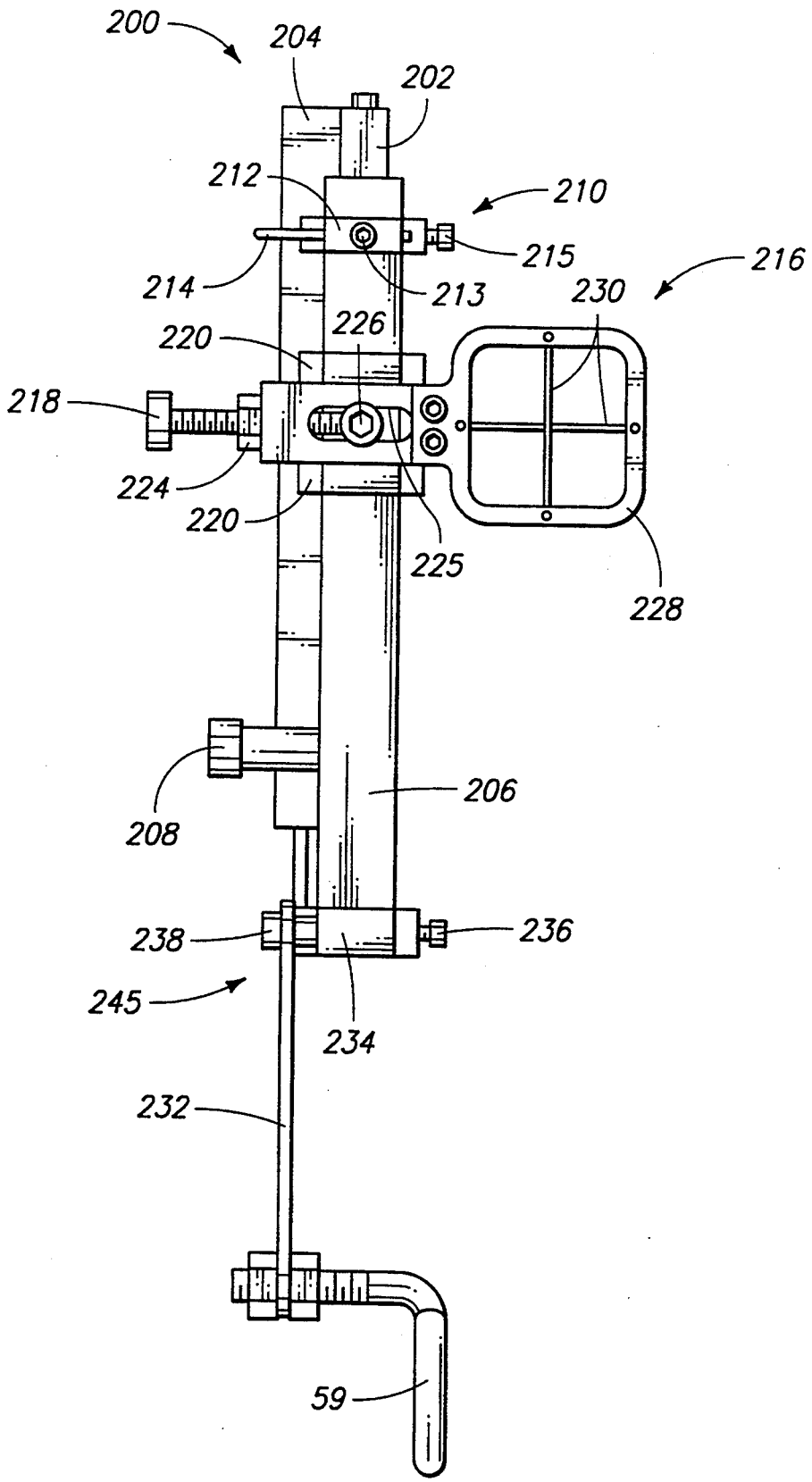
FIG. 18 is a front elevation view of the adjustable archery bow sight of FIG. 17.

FIGS. 17 and 18 show yet another aspect of the present invention. Specifically, FIGS. 17 and 18 illustrate an alternative embodiment of an adjustable archery bow sight 200 for use on an archery bow (not shown). Similar to the embodiments discussed above, the bow sight 200 comprises a base member 26 which defines a plurality of apertures 28 for allowing the bow sight 200 to be mounted to an archery bow at various locations through the apertures. An integral attachment end 203 is formed on one end of the base member 26.

The adjustable archery bow sight 200 further comprises a stationary block 202 and a range gauge 204. The stationary block 202 is fixedly secured to the integral attachment end 203 of the base member 26. The range gauge 204 is fixedly secured between the attachment end and the stationary block. The range gauge provides multiple points of reference to the archer for measuring the movement and monitoring the location of the sight device (described below).

A ranging slide bar 206 is adjustably and slidably coupled to the stationary block 202. The slide bar 206 and the block 202 are configured to nest together in a dove-tail mounting arrangement for controllable, slidable movement relative to one another. A threaded locking screw 208 is threadably received by the stationary block 202. The locking screw directly engages and is bearable against the ranging slide bar 202 to lock the slide bar in position relative to the stationary block.

A range marker 210 comprises an adjustable mounting block 212 and an indicator pin 214. The indicator pin is secured to the mounting block by fastener 213. The mounting block is adjustably secured to the ranging slide bar 206 by fastener 215 (FIG. 18). The indicator pin 214 moves relative to the range gauge 204 to indicate a reference point on the range gauge. The indicator pin will point to various reference points as the ranging sliding bar 206 moves relative to the stationary block 202 and the gauge 204.

The adjustable archery bow sight of FIGS. 17 and 18 further comprises a sight device 216 coupled to the ranging slide bar 206. The sight device includes a mounting base 220 and a dove-tail shaped lateral adjustment bar 222 adjustably securable to the mounting base 220. The mounting base is secured in place relative to the ranging slide bar 206 by means of fastener 226 (FIG. 18). The position of the adjustment bar 222 can be moved laterally by means of a lateral adjustment screw 218. Fastener 226 rides in a slot 225 formed in the bar 222 when lateral adjustments are made. The fastener is tightened to secure the bar 222 in a desired position after lateral adjustments have been made. A lock nut 224 prevents further rotation of the adjustment screw.

The sight device shown in FIGS. 17 and 18 involves a cross-hair type sight device, which comprises a frame 228 coupled to the lateral adjustment bar 222 and a pair of cross hairs 230 coupled to the frame. The frame creates a window through which the archer views the target, with the cross hairs positioned on the target.

The adjustable archery bow sight 200 still further comprises a linkage assembly 245 comprising a lever 232 and a dual pivot link 244. A dual pivot link 244 is pivotally coupled between the lever 232 and the base 26 at pivot points 246 and 248, respectively. The lever is pivotally coupled to the ranging slide bar 206 by means of a mounting bracket 234 (FIG. 18) at pivot point 238. The mounting bracket is adjustably secured to the ranging slide bar by fastener 236.

The lever 232 includes multiple apertures 240 which form alternative pivot points for mounting the lever to the ranging slide bar. As such, the lever 232 provides an adjustable link or adjustment means for adjusting the range of movement through which the ranging slide bar passes.

A ring 59 is coupled to the lever at mounting location 241. The lever 232 also defines an alternative mounting location 242 for mounting the ring 59. The alternate mounting location allows the position of the ring to be adjusted relative to the archery bow sight 200.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An archery bow sight, comprising:
a base member;
a stationary block coupled to the base member;
a ranging slide bar mounted adjacent the block, the slide bar being controllably moveable in a plane parallel to the block within a range of movement;
a range marker fixedly coupled to the ranging slide bar for movement therewith;
a sight device fixedly coupled to the ranging slide bar for movement therewith;
a lever pivotally coupled to the ranging slide bar to controllably move the slide bar through the range of movement; and
a linkage assembly pivotally interconnecting the lever and the base member, the linkage assembly including an adjustable link to adjust the range of movement through which the ranging slide bar passes.

2. The archery bow sight of claim 1 wherein the linkage assembly further includes a dual pivot member pivotally connected between the lever and the adjustable link to enable travel of the ranging slide bar in the plane parallel to the block.

3. An archery bow sight, comprising:
a base member;
a stationary block coupled to the base member;
a ranging slide bar mounted adjacent the block, the slide bar being controllably moveable in a plane parallel to the block within a range of movement;
a range marker fixedly coupled to the ranging slide bar for movement therewith;
a sight device fixedly coupled to the ranging slide bar for movement therewith;
a lever pivotally coupled to the ranging slide bar to controllably move the slide bar through the range of movement; and
wherein the lever includes a plurality of apertures through which the ranging slide bar can be alternatively mounted for adjusting the range of movement.

4. An archery bow sight, comprising:
a base member;
a stationary block coupled to the base member;
a ranging slide bar mounted adjacent the block, the slide bar being controllably moveable in a plane parallel to the block within a range of movement;
a range marker fixedly coupled to the ranging slide bar for movement therewith;
a sight device fixedly coupled to the ranging slide bar for movement therewith;
a lever pivotally coupled to the ranging slide bar to controllably move the slide bar through the range of movement; and
an adjustable linkage interconnecting the ranging slide bar and the block to adjust the range of movement of the ranging slide bar resulting from a constant travel range of the lever.

5. An archery bow sight, comprising:
a base member;
a stationary block coupled to the base member;
a ranging slide bar mounted adjacent the block, the slide bar being controllably moveable along the block within a range of movement relative to the block;
a sight device fixedly coupled to the ranging slide bar for movement therewith;
a range marker coupled to the ranging slide bar for movement therewith;
a range gauge coupled to the stationary block, the range gauge including a plurality of reference marks;
control means for controllably moving the ranging slide bar relative to the stationary block; and
adjustment means for varying the range of movement of the slide bar relative to the stationary block.

6. The archery bow sight of claim 5, further comprising means for locking the ranging slide bar relative to the stationary block.

7. The archery bow sight of claim 5 wherein movement of the control means is proportional to movement of the ranging slide bar, the adjustment means varying the proportionality of movement between the control means and the ranging slide bar.

8. The archery bow sight of claim 5 wherein the control means moves at an input rate of movement and the ranging slide bar moves at an output rate, the adjustment means varying the output rate of movement of the slide bar for a constant input rate of movement of the control means.

9. The archery bow sight of claim 5 wherein the range gauge is planar.

10. The archery bow sight of claim 5 wherein the ranging slide bar comprises an incrementally adjustable slide bar.

11. An archery bow sight, comprising:
a base member;
a stationary block coupled to the base member;
a ranging slide bar mounted adjacent the block, the ranging slide bar being controllably moveable along the block within a range of movement relative to the block;

a sight device fixedly coupled to the ranging slide bar for movement therewith;

a range marker coupled to the ranging slide bar for movement therewith;

a range gauge coupled to the stationary block, the range gauge including a plurality of reference marks;

a multiple pivot point linkage assembly interconnected between the ranging slide bar and the base member, the multiple pivot point linkage assembly allowing the ranging slide bar to move in a plane parallel to the stationary block;

wherein the multiple pivot point linkage assembly includes an adjustable link to adjust the range of movement of the ranging slide bar.

12. An archery bow sight, comprising:

a base member;

a stationary block coupled to the base member;

a ranging slide bar mounted adjacent the block, the ranging slide bar being controllably moveable along the block within a range of movement relative to the block;

a sight device fixedly coupled to the ranging slide bar for movement therewith;

a range marker coupled to the ranging slide bar for movement therewith;

a range gauge coupled to the stationary block, the range gauge including a plurality of reference marks;

a multiple pivot point linkage assembly interconnected between the ranging slide bar and the base member, the multiple pivot point linkage assembly allowing the ranging slide bar to move in a plane parallel to the stationary block;

wherein the multiple pivot point linkage assembly includes the lever having a plurality of apertures through which the ranging slide bar can be alternatively mounted for adjusting the range of movement.

13. An archery bow sight, comprising:

a base member;

a stationary block coupled to the base member;

a ranging slide bar mounted adjacent the block, the slide bar being controllably moveable relative to the block through a range of movement;

a sight device fixedly coupled to the ranging slide bar for movement therewith;

a range gauge coupled to the stationary block, the range gauge including a plurality of reference points;

a range marker fixedly coupled to the ranging slide bar for movement therewith, the range marker indicating a particular reference point on the range gauge;

a moveable lever coupled to the ranging slide bar to impart an output rate of movement to the slide bar upon an input rate of movement being imparted to the lever, thus defining an input-to-output speed ratio; and adjustment means for varying the speed ratio.

14. The archery bow sight of claim 13 wherein the adjustment means comprises a linkage assembly including an adjustable link, and the moveable lever has an effective length, the adjustable link being variably adjustable to change the effective length of the lever to vary the speed ratio.

15. The archery bow sight of claim 13 wherein the adjustment means comprises a plurality of apertures defined by the lever, the lever being pivotally attachable to the ranging slide bar alternatively through one of the plurality of apertures to vary the speed ratio.

16. An archery bow sight, comprising:

a base member;

a stationary block coupled to the base member;

a ranging slide bar mounted adjacent the block, the slide bar being controllably moveable relative to the block through a range of movement;

a sight device fixedly coupled to the ranging slide bar for movement therewith;

a range gauge coupled to the stationary block, the range gauge including a plurality of reference points;

a range marker fixedly coupled to the ranging slide bar for movement therewith, the range marker indicating a particular reference point on the range gauge;

a moveable lever coupled to the ranging slide bar to impart an output rate of movement to the slide bar upon an input rate of movement being imparted to the lever, thus defining an input-to-output speed ratio; and a plurality of individually selectable pivot points for mounting the lever to the ranging slide bar.

17. An archery bow sight according to claim 16 wherein the lever is pivotally securable to the ranging slide bar at one of the pivot points.

18. An archery bow sight according to claim 16 wherein the lever is pivotally securable to the ranging slide bar at one of the pivot points and a different speed ratio is achieved when the lever is coupled to the ranging slide bar at different pivot points.

19. An archery bow sight according to claim 16 wherein the plurality of pivot points comprises at least three.

20. An archery bow sight according to claim 16 wherein mounting the lever to the ranging slide bar at different pivot points provides different effective lengths of the lever.

21. An archery bow sight according to claim 16 wherein the multiple pivot points comprise multiple apertures formed in the lever.

22. An archery bow sight, comprising:

a base member;

a stationary block coupled to the base member;

a ranging slide bar mounted adjacent the block, the slide bar being controllably moveable in a plane parallel to the block within a range of movement;

a range marker fixedly coupled to the ranging slide bar for movement therewith;

a sight device fixedly coupled to the ranging slide bar for movement therewith;

a lever pivotally coupled to the ranging slide bar to controllably move the slide bar through the range of movement;

a plurality of pivot points for interconnecting the lever to the ranging slide bar; and wherein mounting the lever to the ranging slide bar at different pivot points changes the range of movement through which the ranging slide bar passes.

23. An archery bow sight, comprising:

a base member;

a stationary block coupled to the base member;

a ranging slide bar mounted adjacent the block, the slide bar being controllably moveable in a plane parallel to the block within a range of movement;

a range marker fixedly coupled to the ranging slide bar for movement therewith;

a sight device fixedly coupled to the ranging slide bar for movement therewith;

a lever pivotally coupled to the ranging slide bar to controllably move the slide bar through the range of movement; and a plurality of pivot points for interconnecting the lever to the ranging slide bar;

wherein the plurality of pivot points comprises multiple apertures formed in the lever.

24. An archery bow sight according to claim 23 wherein the plurality of pivot points comprise at least three.

* * * * *